US005847702A

United States Patent [19]

Jung

[11] Patent Number: 5,847,702

[45] Date of Patent: Dec. 8, 1998

[54] LIQUID CRYSTAL DISPLAY DEVICE HAVING A POWER SAVING FUNCTION

[75] Inventor: Ki-Seok Jung, Incheon, Rep. of Korea

[73] Assignee: Samsung Electronics Co., Ltd., Kyungki-do, Rep. of Korea

[21] Appl. No.: 766,878

[22] Filed: Dec. 13, 1996

[30] Foreign Application Priority Data

Dec. 13, 1995 [KR] Rep. of Korea ..... 95-49320

[51] Int. Cl.[6] ..... G09G 5/00

[52] U.S. Cl. ..... 345/211; 345/212

[58] Field of Search ..... 345/87, 94, 211, 345/212; 364/707

[56] References Cited

U.S. PATENT DOCUMENTS

| | | | |
|---|---|---|---|
| 5,130,703 | 7/1992 | Fairbanks et al. | 345/211 |
| 5,315,311 | 5/1994 | Honkala | 345/212 |
| 5,343,221 | 8/1994 | Arakawa et al. | 345/211 |

*Primary Examiner*—Matthew Luu
*Attorney, Agent, or Firm*—Cushman Darby & Cushman IP Group of Pillsbury Madison & Sutro LLP

[57] ABSTRACT

A liquid crystal display device capable of saving power consumption is provided. The liquid crystal display device reduces the power consumption by decreasing an output voltage of a voltage dividing element thereof and by changing common output signals (alternating current) of a row driver and segment output signals of a column driver make direct current uniformly. In order to achieve the above object, the LCD of this invention includes: a central processing unit for producing data signals when the display device is in on-condition and a power down signal when the display device is in off-condition; a liquid crystal driver controller for receiving an input voltage and divided voltages and for producing an first voltage, segment-output signals and common-output signals when the central processing unit produces the data signals, and for producing a second voltage and direct current voltages when the central processing unit produces the power down signal. In this device, the first voltage is higher than the second voltage in magnitude; the voltage dividing element divides the first or second voltages and produces the divided voltages to the liquid crystal driver controller; and a liquid crystal display panel receives the segment-output signals and common-output signals and displays information of the central processing unit.

4 Claims, 7 Drawing Sheets

LIQUID CRYSTAL DISPLAY DEVICE HAVING A POWER SAVING FUNCTION

BACKGROUND OF THE INVENTION (1) Field of the Invention

The present invention relates to a liquid crystal display device (hereinafter called a LCD) having a power saving function, and more particularly to a liquid crystal display device with reduced power consumption due to decreased current requirements for signals supplied to the LCD panel, and voltage which is supplied to a voltage dividing circuit of the LCD.

(2) Description of the Prior Art

LCDs have been adapted to many electronic systems to display information being manipulated by the systems. A conventional LCD will now be described with reference to the attached drawings. FIG. 1 is a block diagram of liquid crystal display device, and FIGS. 2A and 2B show voltage waveforms of the common-output signal produced from a row driver and the segment-output signal produced from a column driver of the LCD, respectively. As shown in FIG. 1, a conventional LCD includes a central processing unit 10, a liquid crystal driver controller 20, a voltage divider 80 and a liquid crystal display panel 70. The central processing unit 10 has a microprocessor which produces various commands to control the system. The liquid crystal driver controller 20 produces an output voltage Vout to the voltage divider 80 according to the commands of the central processing unit 10 and an input voltage Vin, and outputs segment-output signal X4 and common-output signal X5 to the liquid crystal display panel 70. The output voltage Vout is divided into the various voltages (V0, V1, V2, V3, V4 and V5) in the voltage divider 80, and supplied to the liquid crystal driver controller 20.

In detail, the liquid crystal driver controller 20 includes a controller 30 for receiving the commands from the central processing unit 10 and producing the control signals (X1, X2 and X3), and a converter 40 for amplifying the input voltage Vin to the output voltage Vout according to the first control signal X1. The controller 20 further includes a column driver 50 for receiving the third control signal X3 and the divided voltages from the voltage divider 80 and producing the segment-output signal X4, and a row driver 60 for receiving the second control signal X2 and the divided voltages from the voltage divider 80 and for producing the common-output signal X4.

In operation, the central processing unit 10 supplies commands to the liquid crystal driver controller 20 to display information which are manipulated by the system. Then the controller 20 receives the commands and produces the control signals X1, X2 and X3 to the converter 40, the row driver 60 and the column driver 50, respectively. The converter 40 amplifies the input voltage Vin, and the voltage divider 80 divides the amplified voltage Vout. V0, V1, V2, V3, V4 and V5 are the divided voltages and the magnitude is in order of V0>V1>V2>V3>V4>V5. The column driver 50 receives the third control signal X3 and the divided voltages V0,V2,V3 and V5 from the voltage divider 80, and outputs the segment-output signal X4. The row driver 60 receives the second control signal X2 and the divided voltages V0, V1, V4 and V5 from the voltage divider 80, and produces the common-output signal X5. The LCD panel displays the information according to the segment-output signal X4 and the common-output signal X5.

LCDs are generally used in portable electronic devices, such as cellular phones and calculators, which use a battery as a power source. Accordingly, power consumption of the device is one of the important factors for the device's quality. However, in conventional LCDs, when characters or figures are not displayed on a display screen (display-off), the output voltages V0, V1, V2, V3, V4 and V5, that is, the common and the segment output signals, are still transmitted to the panel 70 as shown in FIG. 2. Accordingly, power consumption of the LCD in the off-condition is not substantially different than the power consumption of the LCD in the on-condition. Display-off condition is the condition which the LCD panel displays only "zero" data, but the system is operated in a normal condition.

SUMMARY OF THE INVENTION

A principle object of the present invention is to provide a LCD capable of reducing power consumption. Another object of the present invention is to provide a LCD with reduced power consumption by decreasing the output voltage of the voltage divider thereof. A further object of the present invention is to provide a LCD with reduced power consumption by changing the common output signals of the row driver and segment output signals of the column driver to make a direct current uniformly.

In order to achieve the above objects, the LCD of this invention includes a central processing unit for producing data signals when the display device is in the on-condition and a power down signal when the display device is in the off-condition, a liquid crystal driver controller for receiving an input voltage and divided voltages, and for producing a first voltage, segment-output signals and common-output signals when the central processing unit produces the data signals, and for producing a second voltage and direct current voltages when the central processing unit outputs the power down signal. In this device, the first voltage is higher than the second voltage in magnitude, a voltage divider is provided for receiving and dividing the first or second voltages and producing the divided voltages for the liquid crystal driver controller, and a liquid crystal display panel receives the segment-output signals and common-output signals to display information of the central processing unit.

In accordance with another embodiment of the present invention, the liquid crystal driver controller includes a controller for producing a first, a second and a third control signals according to the data signals and the power down signal of the central processing unit, a converter for amplifying the input voltage to the first or second voltage according to the first control signal, a row driver for receiving the second control signal and the divided voltages from the voltage divider, and for producing the common output signals, and a column driver for receiving the third control signal and the divided voltages from the voltage divider, and for producing the segment output signals.

BRIEF DESCRIPTION OF THE DRAWINGS

The preferred embodiments of the present invention will now be described more specifically with reference to the attached drawings, wherein.

DETAILED DESCRIPTION OF THE PREFERRED EMBODIMENTS

Preferred embodiments of the present invention will now be described with reference to the accompanying drawings.

Figure 1:
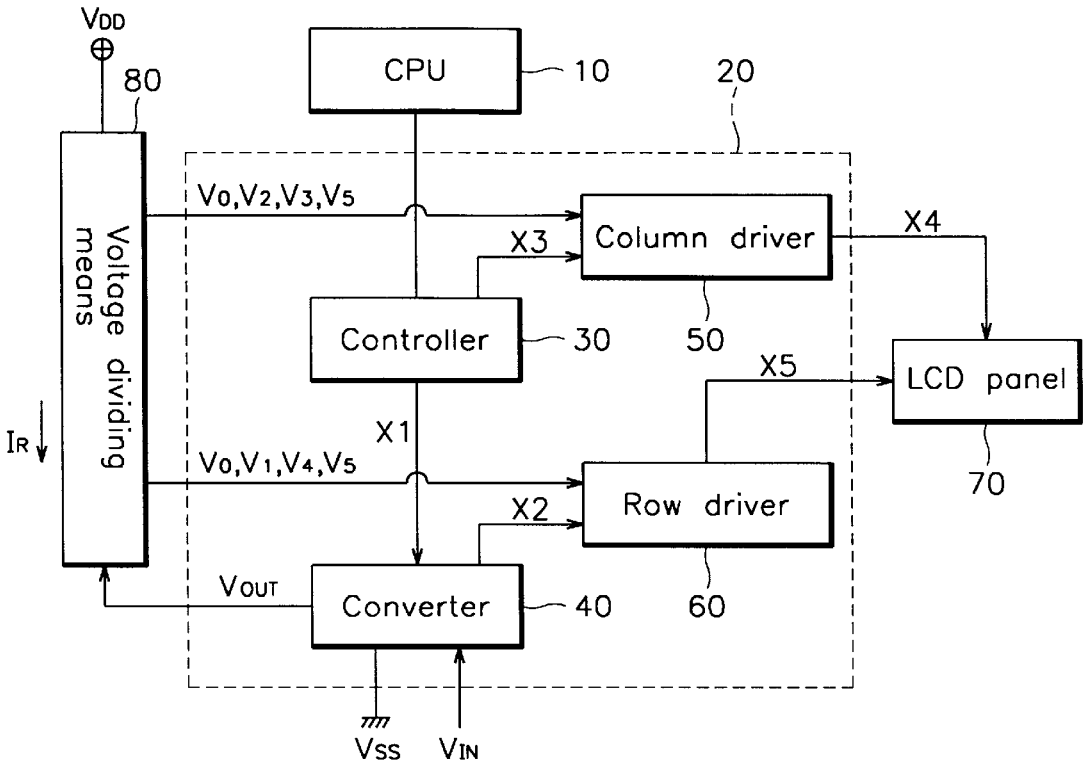
FIG. 1 is a block diagram of a conventional LCD.
Figure 2A:
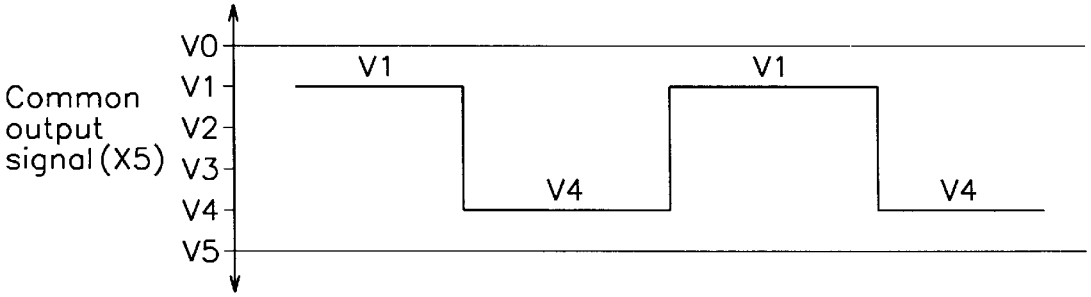
FIGS. 2A and 2B show voltage waveforms of the common-output signal produced from a row driver and the segment-output signal produced from a column driver of the conventional LCD of FIG. 1, respectively.
Figure 2B:
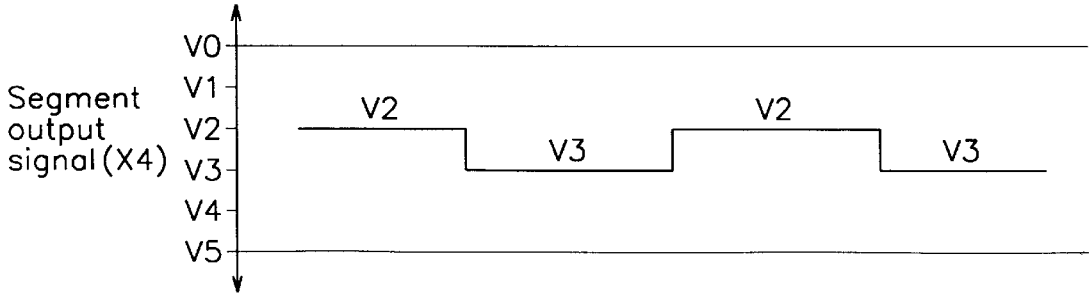

As shown in FIG. 1, the LCD having power saving functions includes a central processing unit 10, a liquid crystal driver controller 20, a voltage divider 80 and a liquid crystal display panel 70.

The central processing unit 10 produces data signals when the display device is in on-condition, and produces a power down signal PDL when the display device is in off-condition. The liquid crystal driver controller 20 produces and outputs a voltage Vout, first voltage, to the voltage dividing element 80 by amplifying an input voltage Vin, and produces and outputs segment-output signals X4 and common-output signals X5 to the liquid crystal display panel 70 according to the divided voltages V1, V2, V3, V4 and V5, when the central processing unit 10 produces the data signals. If the liquid crystal driver controller 20 receives the power down signal PDL, then, the liquid crystal driver controller 20 produces voltage Vout, second voltage, which is not amplified, and further produces and outputs direct current voltages as the segment output signals X4 and common output signals X5 to the liquid crystal display panel 70. The voltage dividing element 80 receives the voltages Vout from the liquid crystal driver controller 20 and divides the voltages and produces the divided voltages V1, V2, V3, V4 and V5 to the liquid crystal driver controller 20. The liquid crystal display panel 70 displays the information of the central processing unit 10 according to the segment-output signals X4 and the common-output signals X5.

In accordance with an embodiment of the present invention, the liquid crystal driver controller 20 includes a controller 30, a converter 40, a row driver 60 and a column driver 50. The controller 30 receives the data signals and the power down signal PDL from the central processing unit 10, and produces a first, a second and a third control signals X1, X2, X3, and outputs them to the converter 40, the row driver 60 and the column driver 50, respectively.

The converter 40 amplifies the input voltage Vin according to the first control signal X1. The voltage dividing element 80 receives the amplified voltage Vout. The voltage dividing element 80 divides the voltage and produces the divided voltages V1, V2, V3, V4 and V5, and outputs them to the liquid crystal driver controller 20. The row driver 60 receives the second control signal X2 from the converter 40 and the divided voltages V0, V1, V4, V5 from the voltage dividing element 80, and produces the common output signals X5. The column driver 50 receives the third control signal X3 from the controller 30 and the divided voltages V0, V2, V3, V5 from the voltage dividing element 80, and produces the segment output signals X4.

Figure 3:
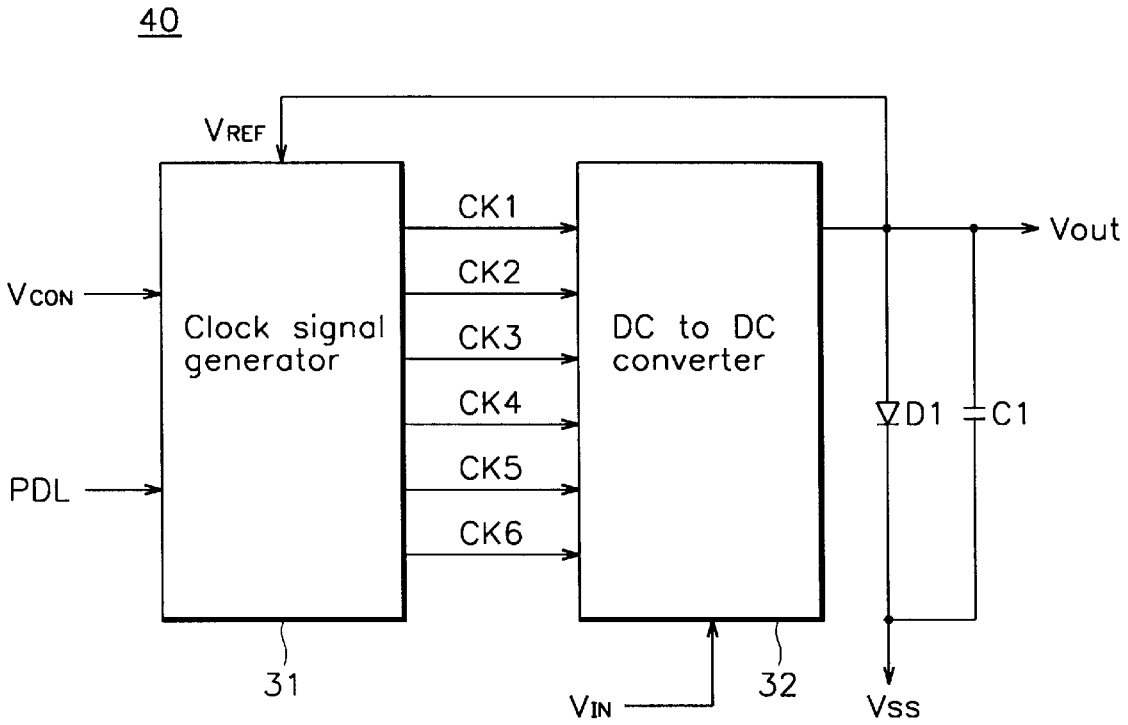
FIG. 3 is a block diagram of the converter of a LCD according to an embodiment of this invention.

In accordance to another embodiment of this invention, as shown in FIG. 3, the converter 40 includes a clock signal generator 31 and a DC to DC converter 32. The clock signal generator 31 produces clock signals CK1 to CK6. However, the clock signal generator 31 produces reset clock signals CK1 to CK6, when the system is in an idle-condition and the controller 30 supplies the power down signal PDL to the clock signal generator 31. The DC to DC converter amplifies the input voltage Vin according to the clock signals CK1 to CK6 in a normal case, but the DC to DC converter is disabled if the disabled clock signals CK1 to CK6 are input to the DC to DC converter 32. If the DC to DC converter is disabled, the output voltage has a ground voltage value of the DC to DC converter.

Figure 7A:
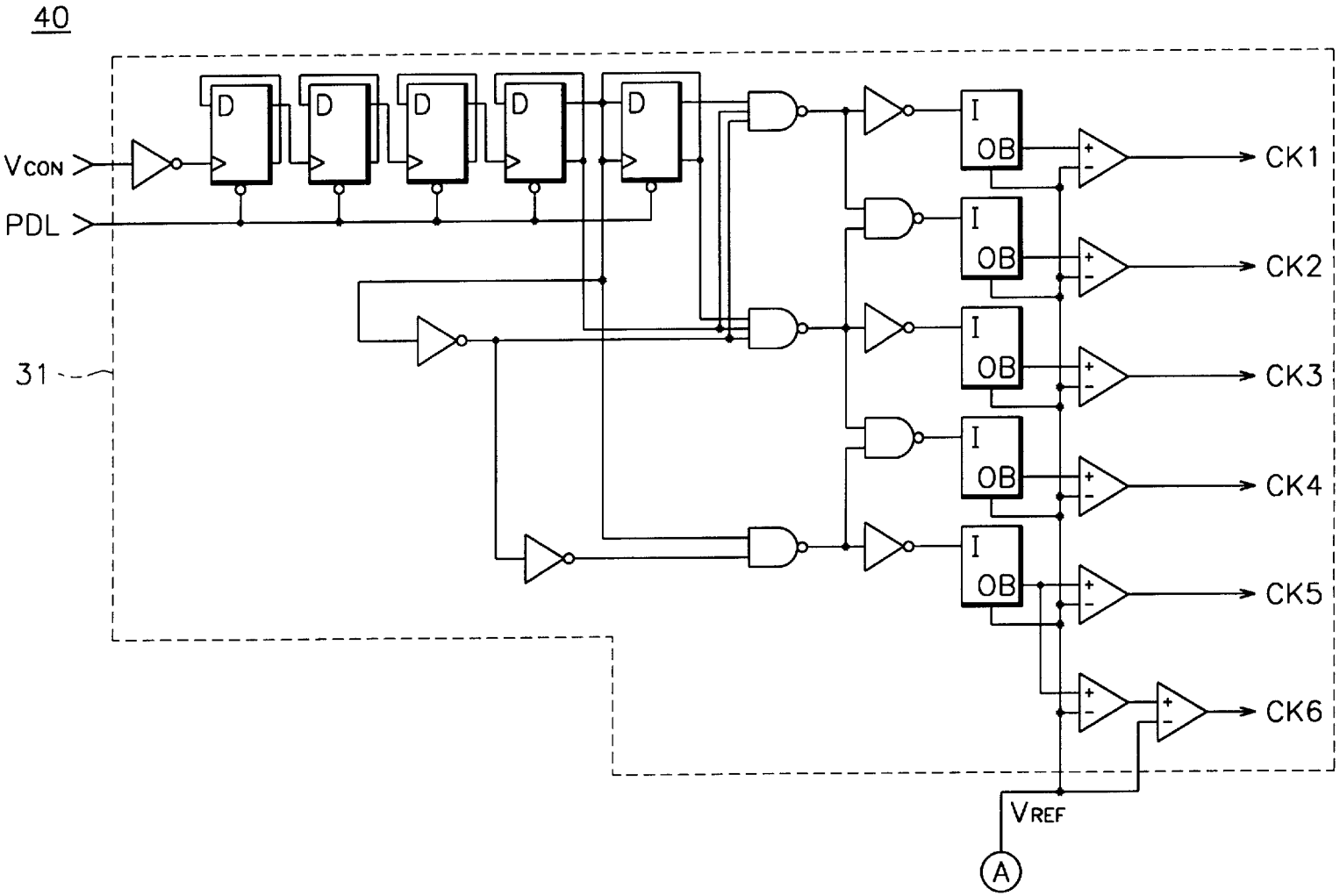
FIGS. 7A and 7B area detailed circuit diagram of the converter according to an embodiment of this invention.
Figure 7B:
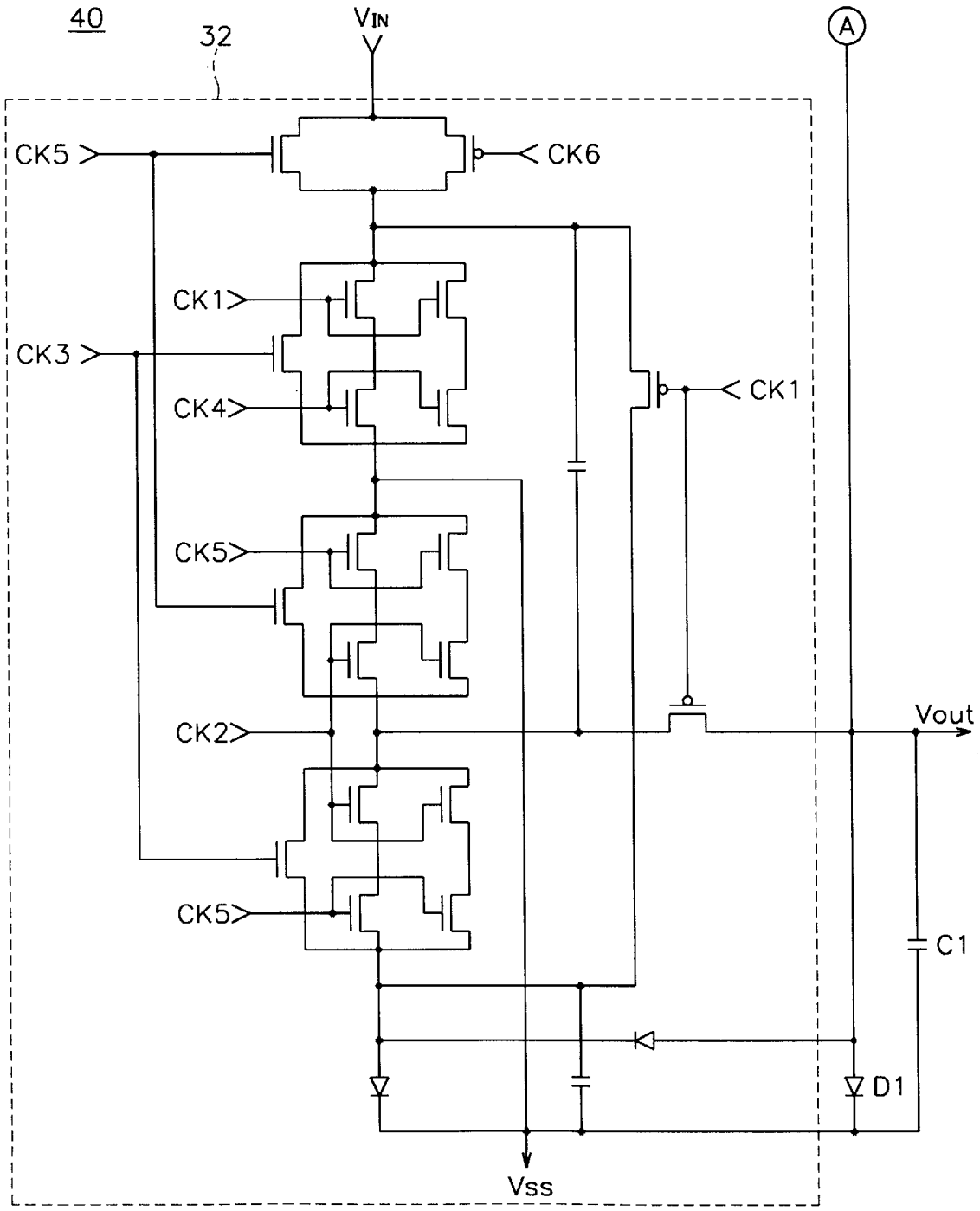

A more detailed circuit diagram of the converter 40 is shown in FIGS. 7A and 7B. In FIGS. 7A and 7B, if the power down signal PDL is not supplied, the output voltage Vout would be −2Vcon when the DC to DC converter is of multiple amplifying, and would be −3Vcon when the converter is of triple amplifying. But, when the power down signal PDL is supplied, the flip-flop circuits and clock signals are reset and the output voltage Vout would be Vss+0.7V which is a voltage of the diode D1. In this case, the current of the voltage dividing means 80 is changed from (Vdd-(−2Vcon))/Rtot to (Vdd-(Vss+0.7))/Rtot, wherein Rtot is a total resistance of the voltage dividing means 80 and Vdd is a voltage of the controller 30. The circuit of FIGS. 7A and 7B is generally called a charge/pump clock signal generator.

Figure 4:
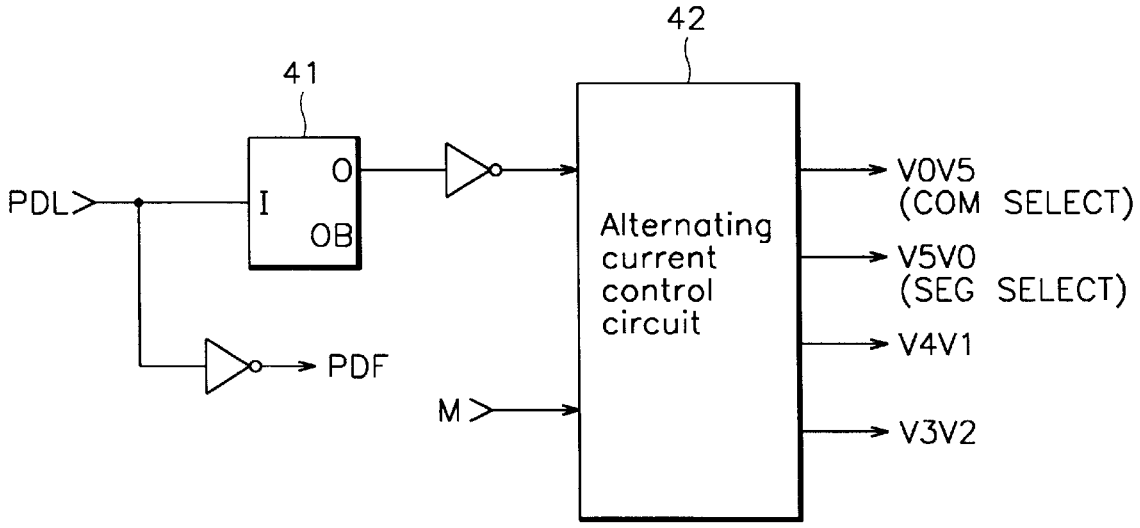
FIG. 4 is a circuit diagram which shows a part of the controller which produces control signals to column or row drivers according to an embodiment of this invention.
Figure 8A:
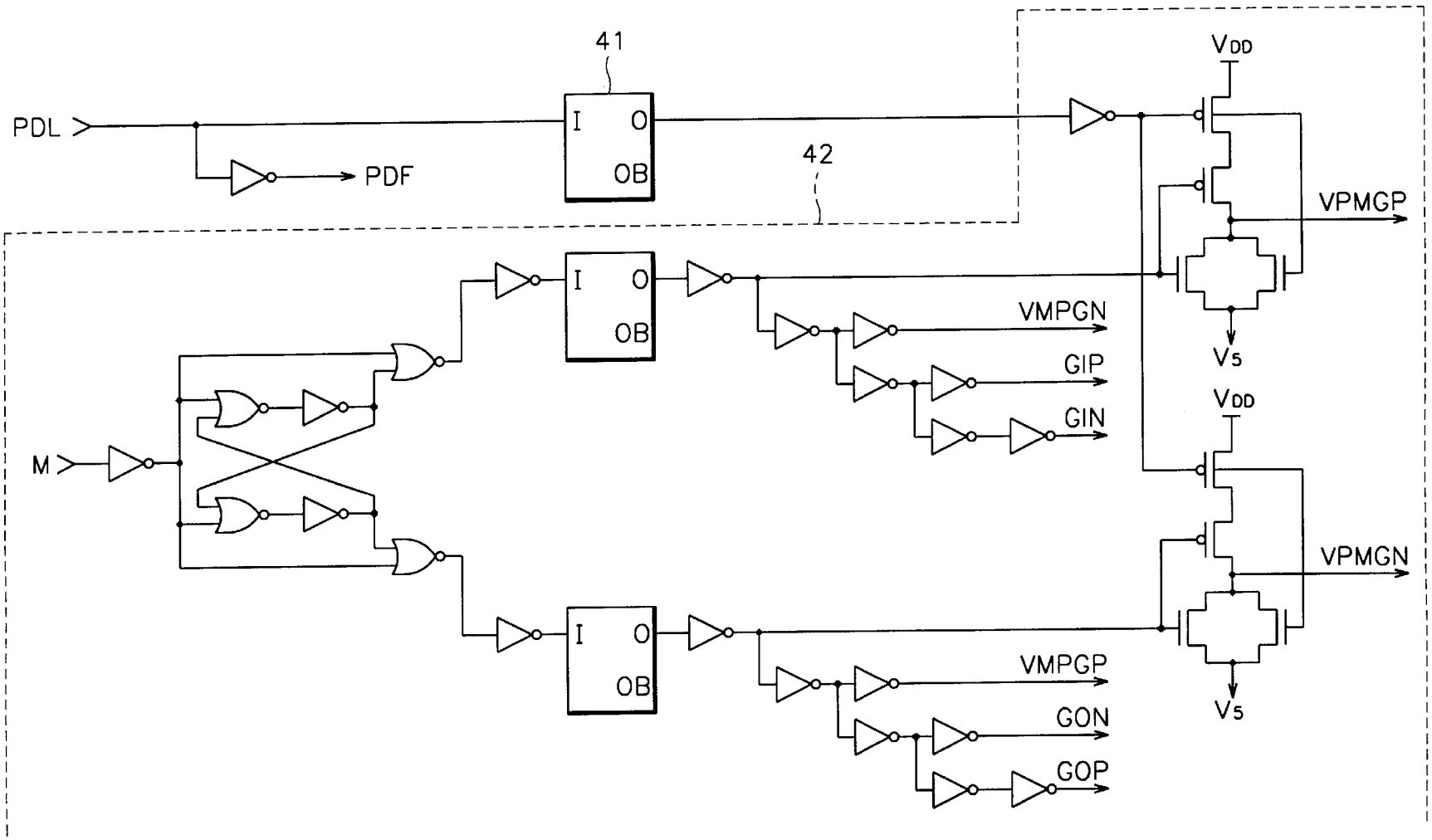
FIGS. 8A and 8B are a detailed circuit diagram of an alternating current source of the control circuit of FIG. 4 according to an embodiment of this invention.
Figure 8B:
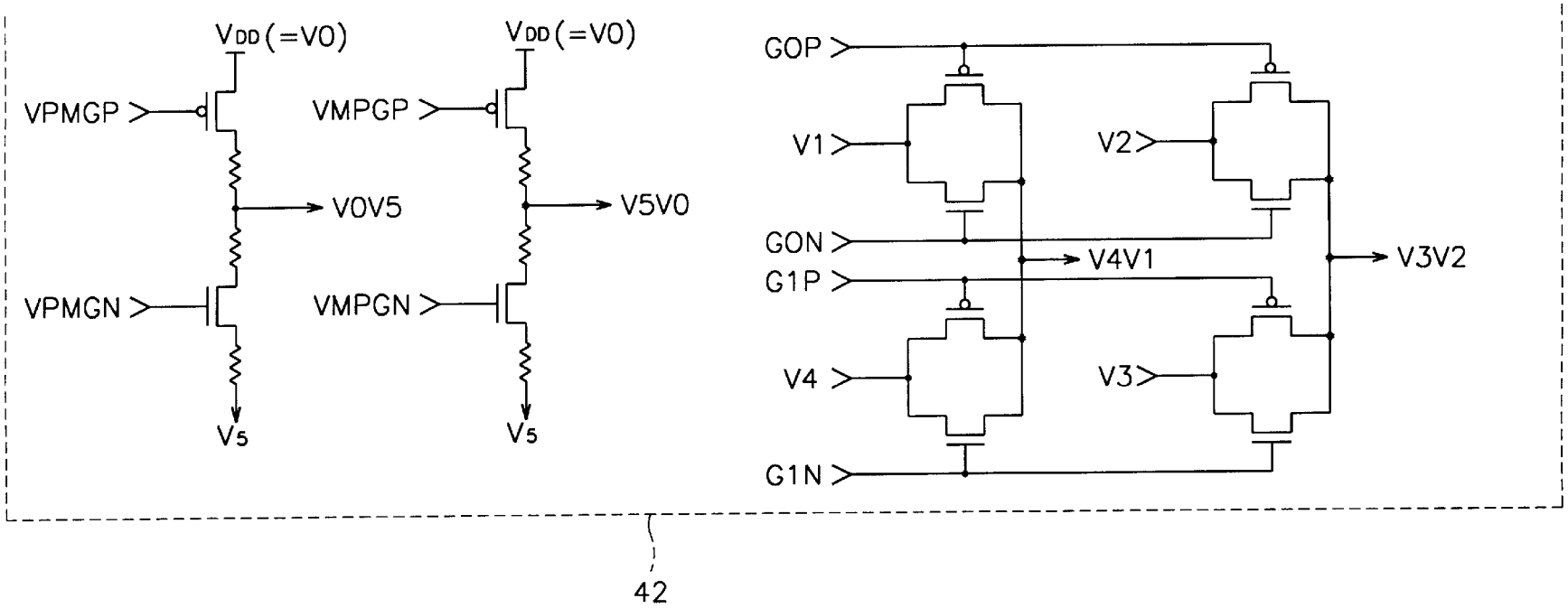

FIG. 4 is a circuit diagram which shows a part of the controller which produces reference signals to the column driver or the row driver according to an alternating current control signal M. In FIG. 4, the reference numeral 41 is a level selector and 42 is an alternating current control circuit which produces reference signals. In the figures, the first reference voltage V5V0 means an alternating current of V0 and V5, which alternates the alternating current according to the phase of an alternating current control signal M. The alternating current control signal M is generated by the controller 30. FIGS. 8A and 8B shows a detailed circuit diagram of an alternating current of the control circuit of FIG. 4.

Figure 5:
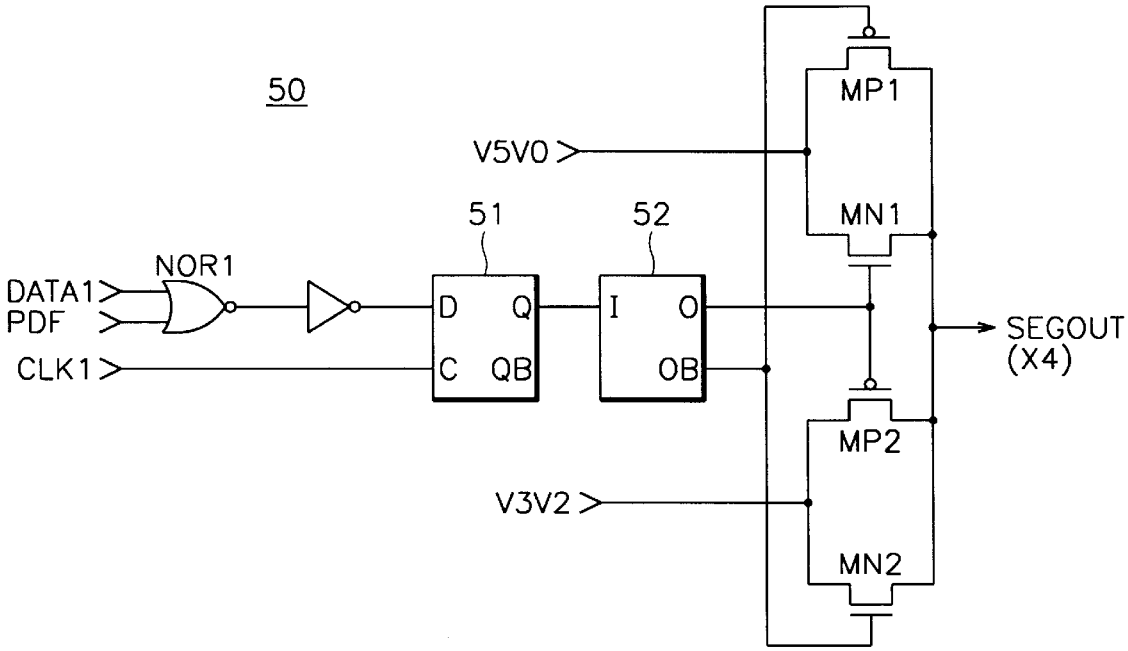
FIG. 5 is a circuit diagram of the column driver according to an embodiment of this invention.

In accordance to further embodiment of this invention, as shown in FIG. 5, the column driver 50 includes a first NOR gate NOR1, a flip-flop 51, a first level shifter 52, a first PMOS transistor MP1, a first NMOS transistor MN1, a second PMOS transistor MP2 and a second NMOS transistor MN2. The first NOR gate NOR1 receives the power down signal PDF and a first data signal DATA 1. The flip-flop circuit 51 receives an inverted output of the first NOR gate NOR1 at a data terminal thereof, and a clock signal at a clock terminal thereof. The first level shifter 52 receives an output of the flip-flop 51 and produces a positive signal and a negative signal from its output terminal O and its inverted output terminal OB.

The gate of the first PMOS transistor MP1 receives the negative signal, and the drain receives a first reference voltage V5V0. The first NMOS transistor MN1 receives the positive signal with its gate, and receives the first reference voltage V5V0 with its drain. The gate of the second PMOS transistor MP2 receives the positive signal and the drain receives a second reference voltage V3V2. The gate of the second NMOS transistor MN2 receives the negative signal and the source receives the second reference voltage, V3V2. The segment output signal X4 is produced from the sources of the first and the second PMOS transistors MP1, MP2, and drains of the first and the second NMOS transistor MN1, MN2.

Figure 6:
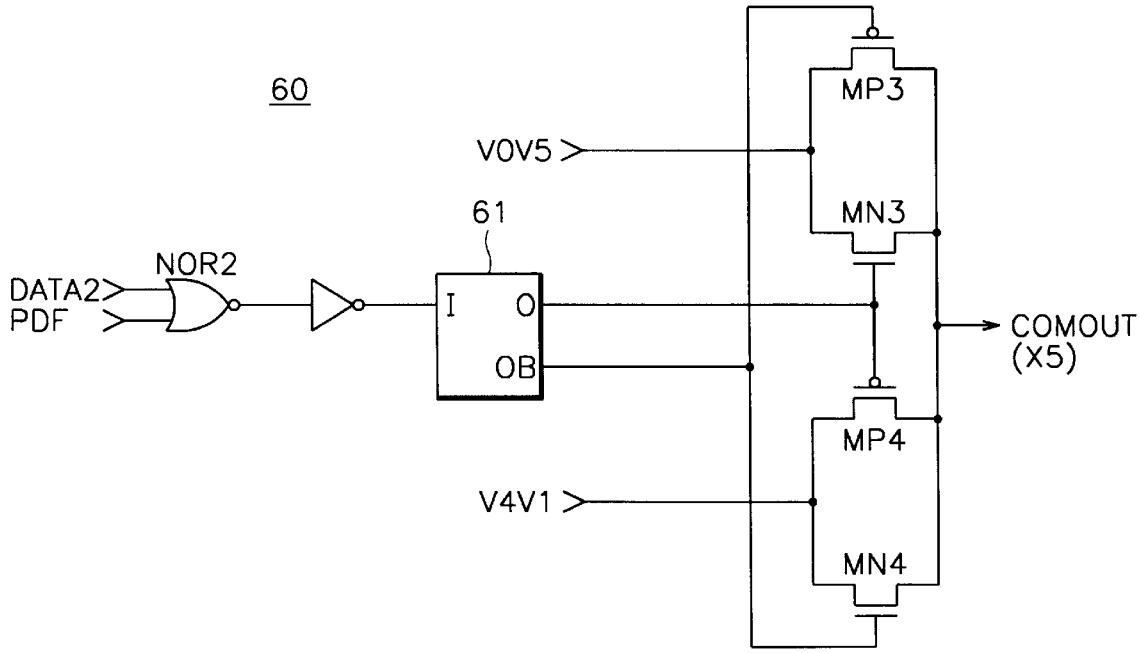
FIG. 6 is a circuit diagram of the row driver according to an embodiment of this invention.

In accordance to further embodiment of this invention, as shown in FIG. 6, the row driver 60 comprises a second NOR gate NOR2, a second level selector 61, a third PMOS transistor MP3, a third NMOS transistor MN3, a fourth PMOS transistor MP4 and a fourth NMOS transistor MN4.

The second NOR gate NOR2 receives the power down signal PDF and a second data signal DATA2. The second level selector 61 receives an inverted output of the second NOR gate NOR2 and produces a positive signal and a negative signal.

The third PMOS transistor MP3 receives the negative signal with its gate and the drain receives a third reference voltage V0V5. The gate of the third NMOS transistor MN3 receives the positive signal and the drain receives the third reference voltage V0V5. The fourth PMOS transistor MP4 receives the positive signal at its gate and the drain receives a fourth reference voltage V4V1. The fourth NMOS transistor MN4 receives the negative signal at its gate and receives the fourth reference voltage V4V1 at its source. The common-output signal X5 is produced by the sources of the third and fourth PMOS transistor MP3, MP4 and the drains of the third and fourth NMOS transistor MN3, MN4, which are connected to each other. The fourth reference voltage V4V1 means an alternating current of V1 and V4, which alternates the current according to the phase of an alternating current control signal M. When the power down signal PDF is input to the row driver 60 and column driver 50, the data of the row driver 60 and column driver 50 are reset and the alternating current control signal M is reset by the power down signal PDF. Thereby the row driver 60 and column driver 50 produce the direct current voltage Vdd. From the above described operation, the current Ir which flows through the voltage dividing circuit 80 and the current Idd which flows through the controller 30 are decreased, thereby the total consumption of the power is decreased. The liquid crystal display device having a power saving function of this invention is particularly used for the liquid crystal display device for displaying characters and symbols.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

This application claims priority from Korean Application No. 95-49320, the content of which is hereby incorporated by reference.

What is claimed is:

1. A liquid crystal display device having a power saving function, comprising:

a central processing unit for producing data signals when the display device is in an on-condition and for producing a power down signal when the display device is in an off-condition;

a liquid crystal driver controller coupled to the central processing for receiving an input voltage and divided voltages and for producing a first voltage, segment-output signals and common-output signals when the central processing unit produces the data signals, and for producing a second voltage and direct current voltages when the central processing unit produces the power down signal, wherein the first voltage is higher than the second voltage in magnitude;

a voltage divider coupled to the liquid crystal driver controller for receiving and dividing the first and second voltages and for supplying the divided voltages to the liquid crystal driver controller;

a liquid crystal display panel coupled to the liquid crystal driver controller for receiving the segment-output signals and common-output signals to display the data signals of the central processing unit and for receiving the direct current voltage when the central processing unit produces the power down signal;

a clock signal generator producing a clock signal and a disable clock signal when the power down signal is sent to the clock signal generator; and a DC to DC converter coupled to the clock signal generator for amplifying the input voltage according to the clock signal, wherein the DC to DC converter is disabled if the disable clock signal is sent to the DC to DC converter.

2. The device according to claim 1, wherein the liquid crystal driver controller comprises:

a controller for producing a first, a second and a third control signals according to the data signals and the power down signal of the central processing unit;

a converter for amplifying an input voltage to the first and second voltages according to the first control signal;

a row driver for receiving the second control signal and the divided voltages from the voltage divider, and for producing the common-output signals; and a column driver for receiving the third control signal and the divided voltages from the voltage divider and for producing the segment output signals.

3. The device according to claim 2, wherein the column driver comprises:

a first NOR gate for receiving the power down signal and data signal;

a flip-flop for receiving a clock signal at a clock electrode thereof and an inverted output of the first NOR gate at a data electrode thereof;

a first level shifter for receiving an output of the flip-flop and producing a positive signal and a negative signal;

a first PMOS transistor whose gate receives the negative signal and whose drain receives a first reference voltage;

a first NMOS transistor whose gate receives the positive signal and whose drain receives the first reference voltage;

a second PMOS transistor whose gate receives the positive signal and whose drain receives a second reference voltage; and a second NMOS transistor whose gate receives the negative signal and whose source receives the second reference voltage, wherein the segment output signal is produced by sources of the first and the second PMOS transistors and drains of the first and the second NMOS transistors.

4. The device according to claim 2, wherein the row driver comprises:

a second NOR gate for receiving the power down signal and data signal;

a second level shifter for receiving an inverted output of the second NOR gate and producing a positive signal and a negative signal;

a third PMOS transistor whose gate receives the negative signal and whose drain receives a third reference voltage;

a third NMOS transistor whose gate receives the positive signal and whose drain receives the third reference voltage;

a fourth PMOS transistor whose gate receives the positive signal and whose drain receives a fourth reference voltage; and a fourth NMOS transistor whose gate receives the negative signal and whose source receives the fourth reference voltage, wherein the common-output signal is produced by sources of the third and fourth PMOS transistor and drains of the third and fourth NMOS transistor.

* * * * *